US008938999B2

(12) United States Patent
Dahl

(10) Patent No.: US 8,938,999 B2
(45) Date of Patent: Jan. 27, 2015

(54) LOCKING CAP APPARATUS AND RELATED METHODS

(71) Applicant: protectRx LLC, Minneapolis, MN (US)

(72) Inventor: Derek Dahl, Minneapolis, MN (US)

(73) Assignee: protectRx LLC, Minneapolis, MN (US)

( * ) Notice: Subject to any disclaimer, the term of this patent is extended or adjusted under 35 U.S.C. 154(b) by 0 days.

(21) Appl. No.: 13/677,077

(22) Filed: Nov. 14, 2012

(65) Prior Publication Data

US 2013/0134121 A1 May 30, 2013

Related U.S. Application Data

(60) Provisional application No. 61/559,544, filed on Nov. 14, 2011.

(51) Int. Cl.
*B65D 55/14* (2006.01)
*B65D 50/06* (2006.01)

(52) U.S. Cl.
CPC ..... *B65D 50/067* (2013.01); *B65D 55/145* (2013.01)
USPC ..... 70/165; 70/63; 70/158; 70/163

(58) Field of Classification Search
USPC ..... 70/63, 158, 163–173
See application file for complete search history.

(56) References Cited

U.S. PATENT DOCUMENTS 1,898,373 A * 2/1933 Jay ..... 70/173
2,226,390 A * 12/1940 Rosevear, Jr. ..... 70/171
3,405,828 A * 10/1968 St. Pierre ..... 70/173
3,445,021 A * 5/1969 Johnson ..... 70/167
3,901,407 A 8/1975 Mitchell et al.
3,973,687 A 8/1976 Glick
4,796,768 A 1/1989 Stuckey
4,848,621 A 7/1989 Radliff
5,212,971 A 5/1993 Yoon et al.
5,317,796 A 6/1994 Hunter
5,351,845 A 10/1994 Hunter
5,911,764 A * 6/1999 Wei Kong ..... 70/160
6,059,132 A 5/2000 Benjamin
6,059,135 A 5/2000 James et al.
6,786,346 B1 9/2004 Gurnard et al.
7,047,773 B1 5/2006 Lin
7,175,038 B2 2/2007 Dolan
7,540,175 B2 * 6/2009 Kalous et al. ..... 70/63
7,600,648 B2 10/2009 Hamer (Continued)

OTHER PUBLICATIONS

Patent Cooperation Treaty, International Searching Authority, Search Report and Written Opinion for PCT/US2012/065088, 11 pages, Apr. 1, 2013.

*Primary Examiner* — Christopher Boswell
(74) *Attorney, Agent, or Firm* — Viksnins Harris & Padys PLLP

(57) ABSTRACT

A locking cap apparatus includes a cap assembly having an outer cap and an inner cap received within the outer cap, and further includes lock setting members. The outer cap includes an actuator coupled with a plunger. The plunger and the actuator are movable within and relative to the outer and inner cap. The cap assembly is rotatably and releasably coupled with external threads of a bottle. The plunger has a locked position, an unlocked position, and a lock change position, where the outer cap is rotatable relative to the bottle when the plunger is in the locked position, unlocked position, and optionally in the combination change position. Lock setting members are interactively coupled with the shaft of the plunger.

19 Claims, 16 Drawing Sheets

(56) References Cited

U.S. PATENT DOCUMENTS

| | | | | |
|---|---|---|---|---|
| 7,891,220 | B2 * | 2/2011 | Yen et al. | 70/63 |
| 8,020,415 | B2 * | 9/2011 | Corbin et al. | 70/63 |
| 2003/0089145 | A1 * | 5/2003 | Michels et al. | 70/169 |
| 2008/0302794 | A1 | 12/2008 | Wagner et al. | |
| 2010/0307208 | A1 | 12/2010 | Corbin et al. | |
| 2011/0049079 | A1 | 3/2011 | Simpson | |
| 2011/0049080 | A1 | 3/2011 | Simpson | |
| 2011/0079058 | A1 | 4/2011 | Nielsen et al. | |
| 2011/0210136 | A1 | 9/2011 | Wang | |

* cited by examiner

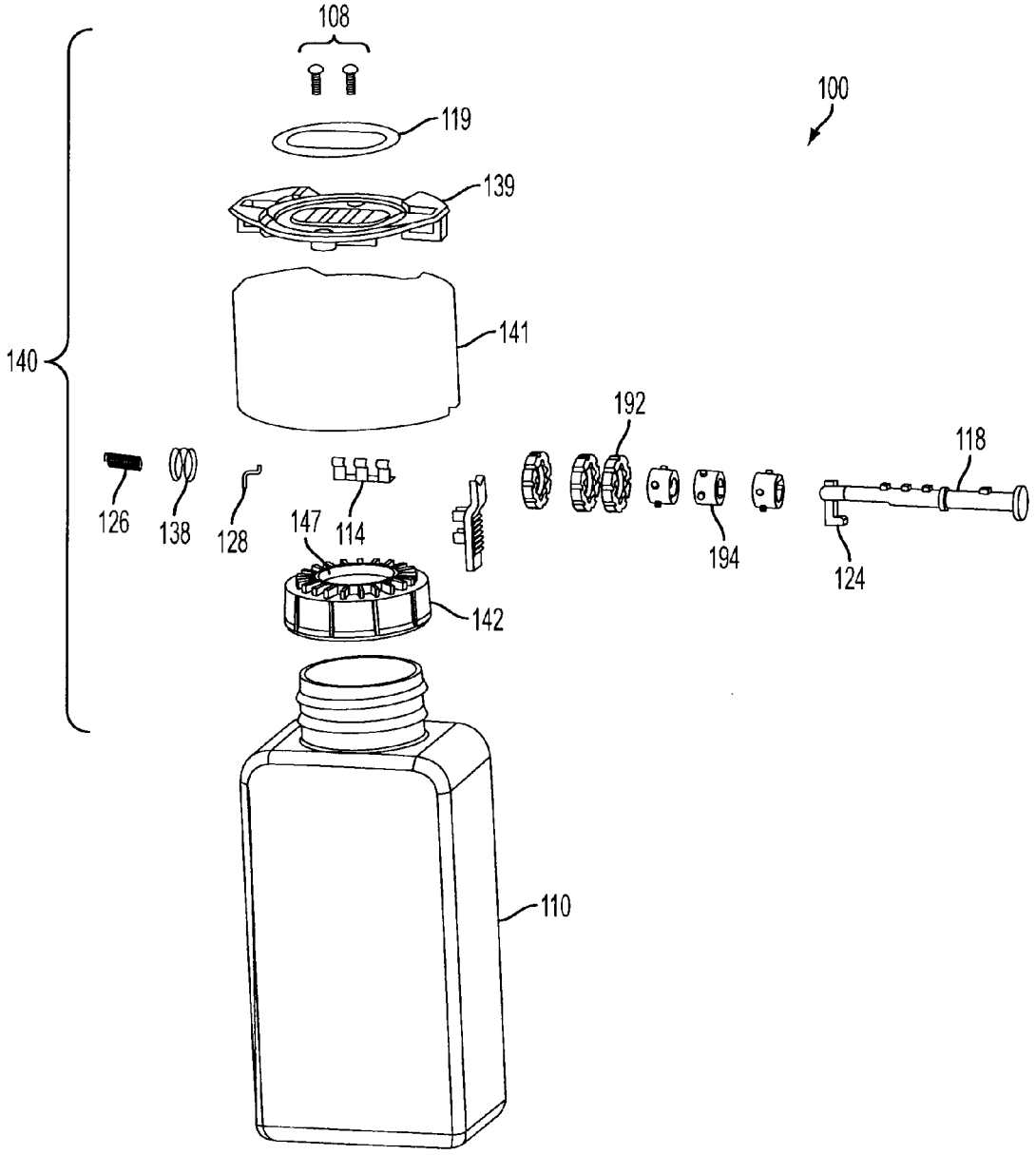
FIG. 2
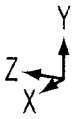

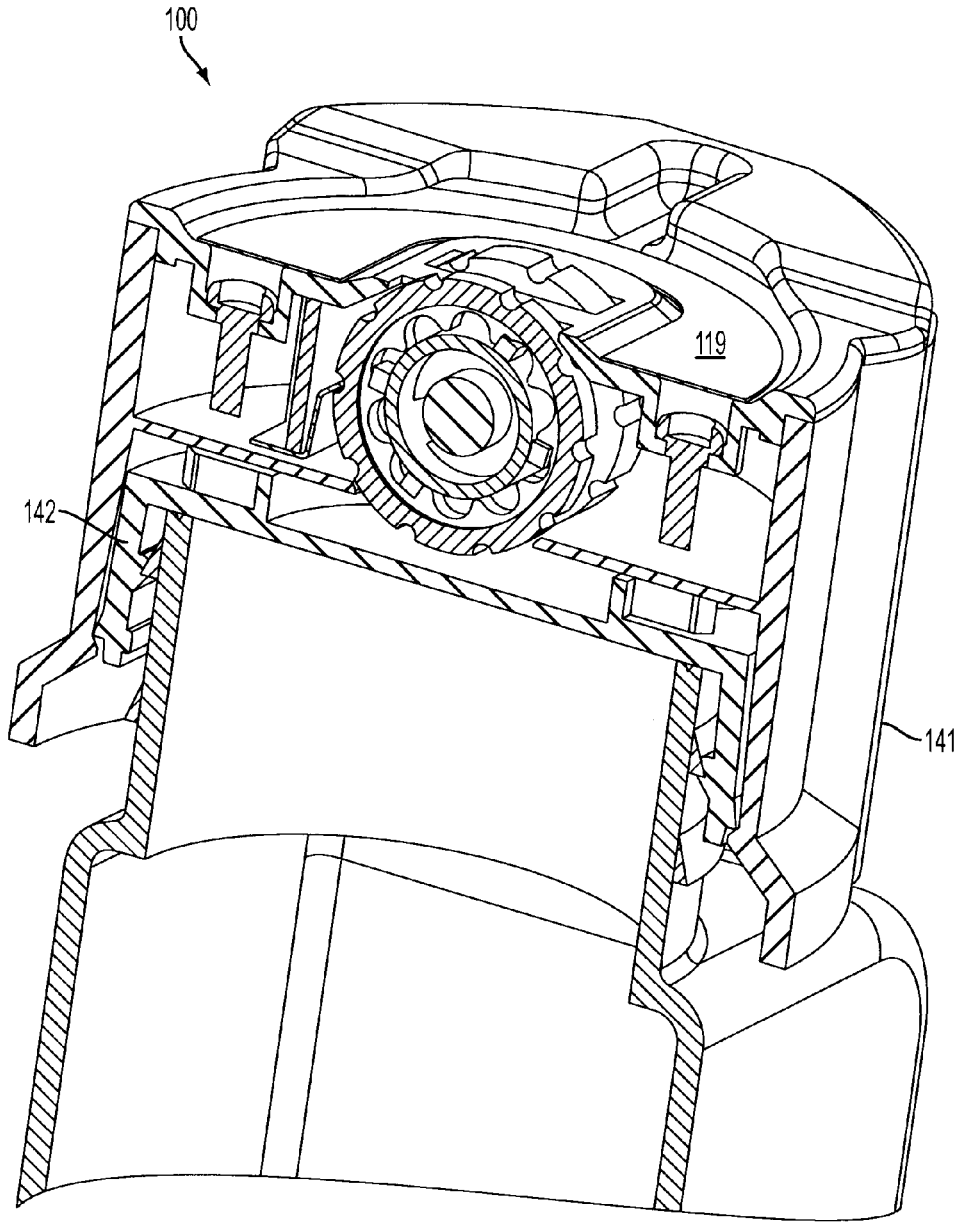
FIG. 3
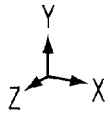

LOCKING CAP APPARATUS AND RELATED METHODS

RELATED APPLICATION

This application claims priority to provisional application entitled "Locking Cap Apparatus and Related Methods" filed on Nov. 14, 2011, having Ser. No. U.S. 61/559,544, and which is incorporated herein in its entirety.

TECHNICAL FIELD

Assemblies useful in locking bottles for prescription drugs, narcotics, alcohol and the like.

BACKGROUND

Childproof prescription drug bottles are available. However, conventional devices fail to prevent other non-authorized users from removing drugs, alcohol, or other contents within bottles. Still further, the owner of the contents cannot detect if some of the contents have been removed or used without authorization.

SUMMARY

In one or more embodiments, a locking cap apparatus includes a cap assembly having an outer cap and an inner cap received within the outer cap, and further includes lock setting members. The outer cap includes an actuator coupled with a plunger. The plunger and the actuator are movable within and relative to the outer and inner cap. The cap assembly is rotatably and releasably coupled with external threads of a bottle. The plunger has a locked position, an unlocked position, and a lock change position, where the outer cap is rotatable relative to the bottle when the plunger is in the locked position, unlocked position, and combination change position. The inner cap is rotatable relative to the outer cap when the plunger is in the locked position, and the inner cap is not rotatable relative to the outer cap and rotates with the outer cap when the plunger is in the unlocked position.

In one or more embodiments, the locking cap apparatus further includes an anti-tamper device coupled with the cap assembly, such as a sticker disposed over fasteners, where removal of the fasteners allow disassembly of the cap assembly from the bottle. In one or more embodiments, the locking cap apparatus further includes at least one adapter coupled with the bottle, the adapter including a second locking member, the first and second locking members adapted to interact with one another, wherein the adapter includes internal threads, and the internal threads are threadingly coupled with external threads of the bottle. In one or more embodiments, the cap assembly further includes a lock change lock out having an access position and a lock out position.

In one or more embodiments, a method comprises rotatably coupling a cap assembly of a locking cap apparatus to a bottle, the cap assembly including an outer cap and an inner cap received within the outer cap, the outer cap including an actuator coupled with a plunger, the plunger movable within and relative to the outer and inner cap, the cap assembly rotatably and releasably coupled with external threads of a bottle, the plunger having a locked position, an unlocked position, and a lock change position, the outer cap is rotatable relative to the bottle when the plunger is in the locked position, unlocked position, and combination change position, the inner cap is rotatable relative to the outer cap when the plunger is in the locked position, the inner cap is not rotatable relative to the outer cap and rotates with the outer cap when the plunger is in the unlocked position, the cap assembly further including lock setting members. The method further includes placing the plunger in a lock change position, setting the lock setting members to a setting, and placing the plunger in the locked position.

A locking cap apparatus includes a cap assembly with a cap having a port, and the cap assembly is rotatably coupled with a bottle, and the bottle has an opening covered by the cap assembly. The locking cap apparatus further includes a locking assembly having a plunger, and the plunger has a locked and unlocked position. The plunger has a shaft and a first locking member, and the plunger partially extends through the port in both the locked and the unlocked position. Lock setting members are interactively coupled with the shaft of the plunger. The locking cap apparatus optionally includes at least one adapter coupled with the bottle, where the adapter includes a second locking member, and the first and second locking members adapted to interact with one another.

A method includes coupling a cap assembly of a locking cap apparatus to a bottle. The method further includes setting lock setting members to a setting, and locking the cap assembly to the bottle including depressing the plunger toward the cap assembly.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

BRIEF DESCRIPTION OF THE FIGURES

FIG. 2 is an exploded perspective view of the locking cap apparatus of FIG. 1 according to one or more embodiments.

FIG. 3 is a cross-sectional view of the locking cap apparatus according to one or more embodiments.

DETAILED DESCRIPTION

The following detailed description includes references to the accompanying drawings, which form a part of the detailed description. The drawings show, by way of illustration, specific embodiments in which the bottle and cap assembly may be practiced. These embodiments, which are also referred to herein as "examples" or "options," are described in enough detail to enable those skilled in the art to practice the present invention. The embodiments may be combined, other embodiments may be utilized or structural or logical changes may be made without departing from the scope of the invention. The following detailed description is, therefore, not to be taken in a limiting sense and the scope of the invention is defined by the appended claims and their legal equivalents.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation.

Figure 1:
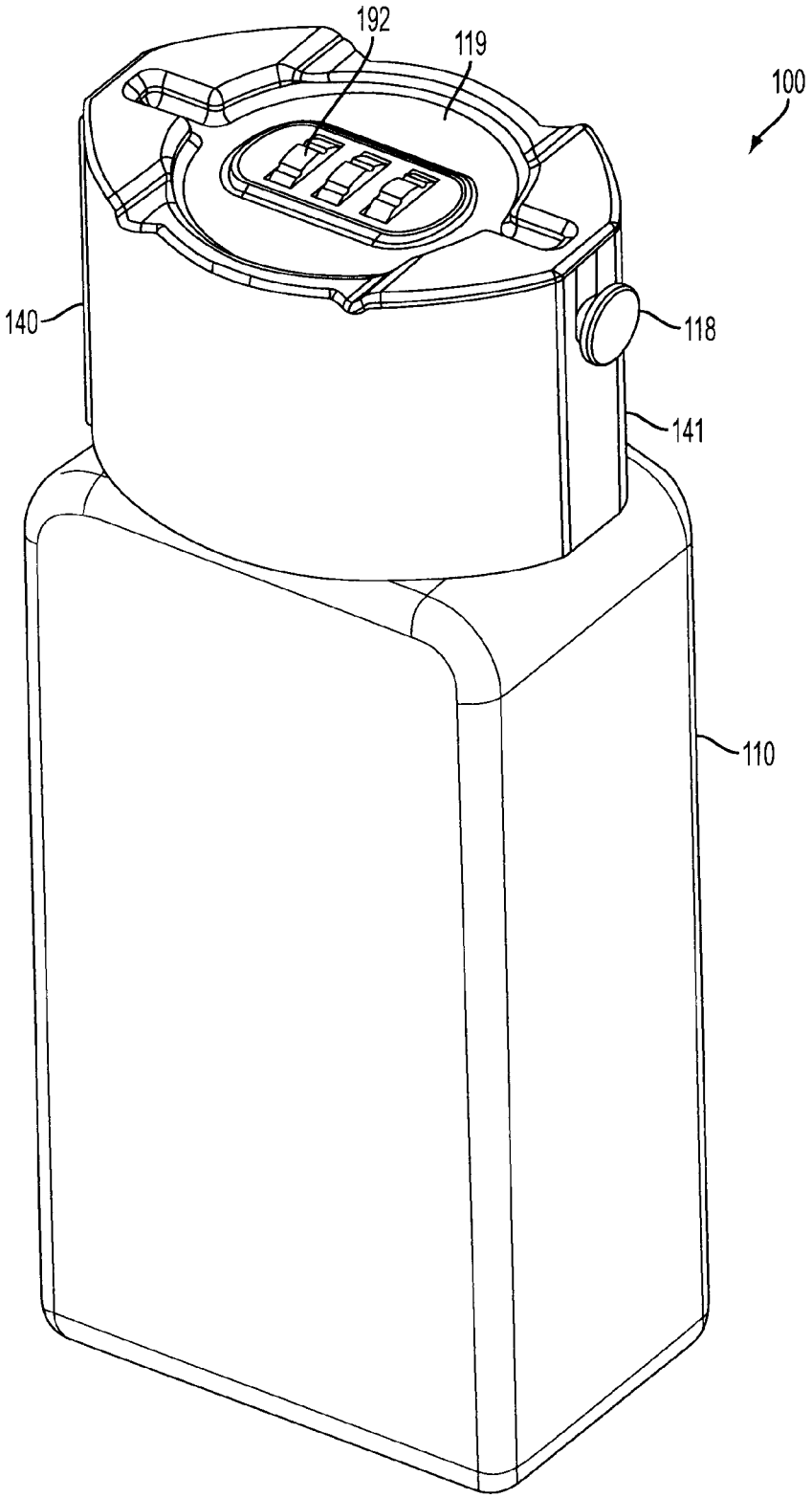
FIG. 1 is a first perspective view of a locking cap apparatus according to one or more embodiments.
Figure 7:
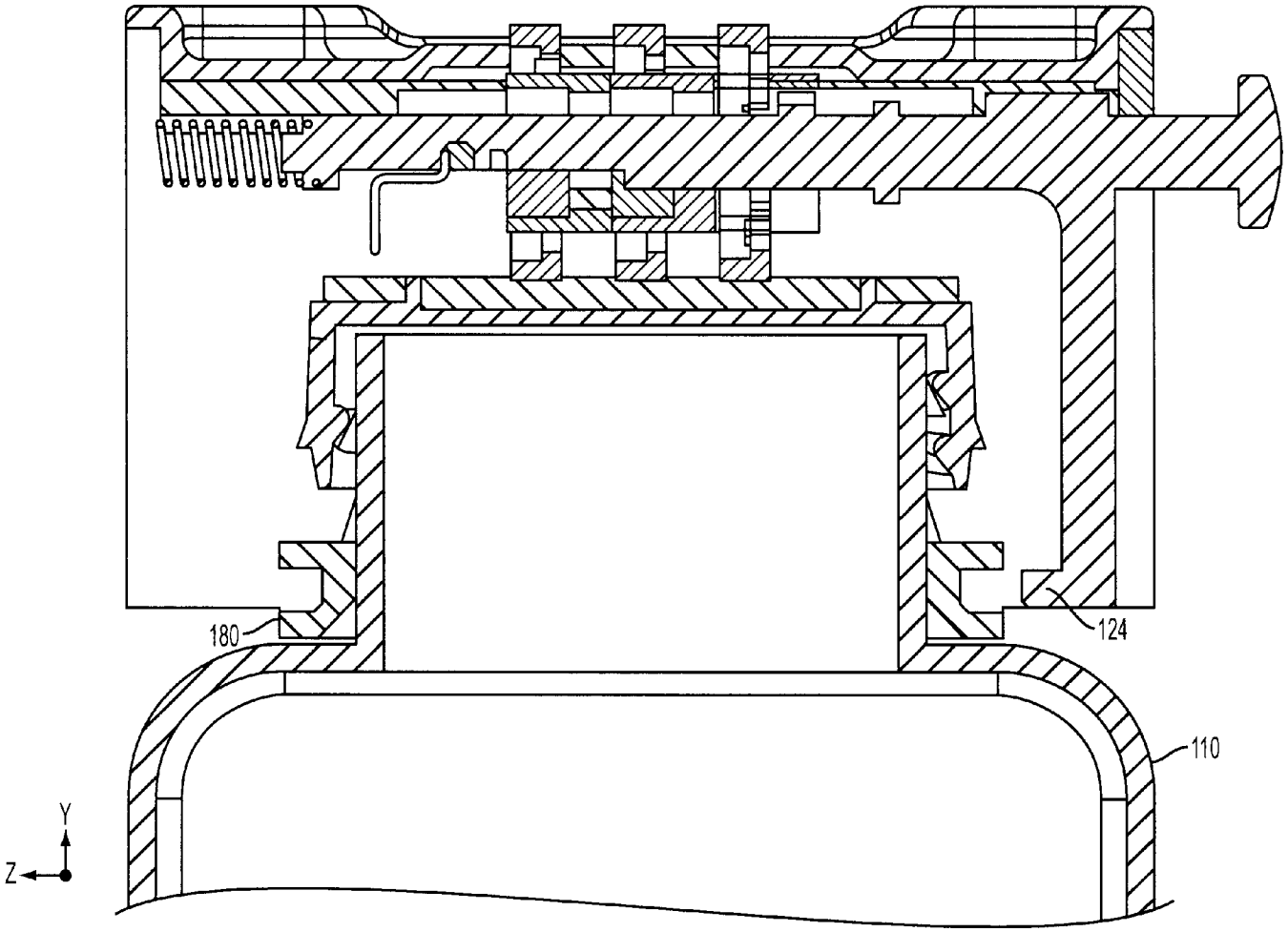
FIG. 7 is a cross-sectional view of the locking cap apparatus according to one or more embodiments, shown in the unlocked position.
Figure 8:
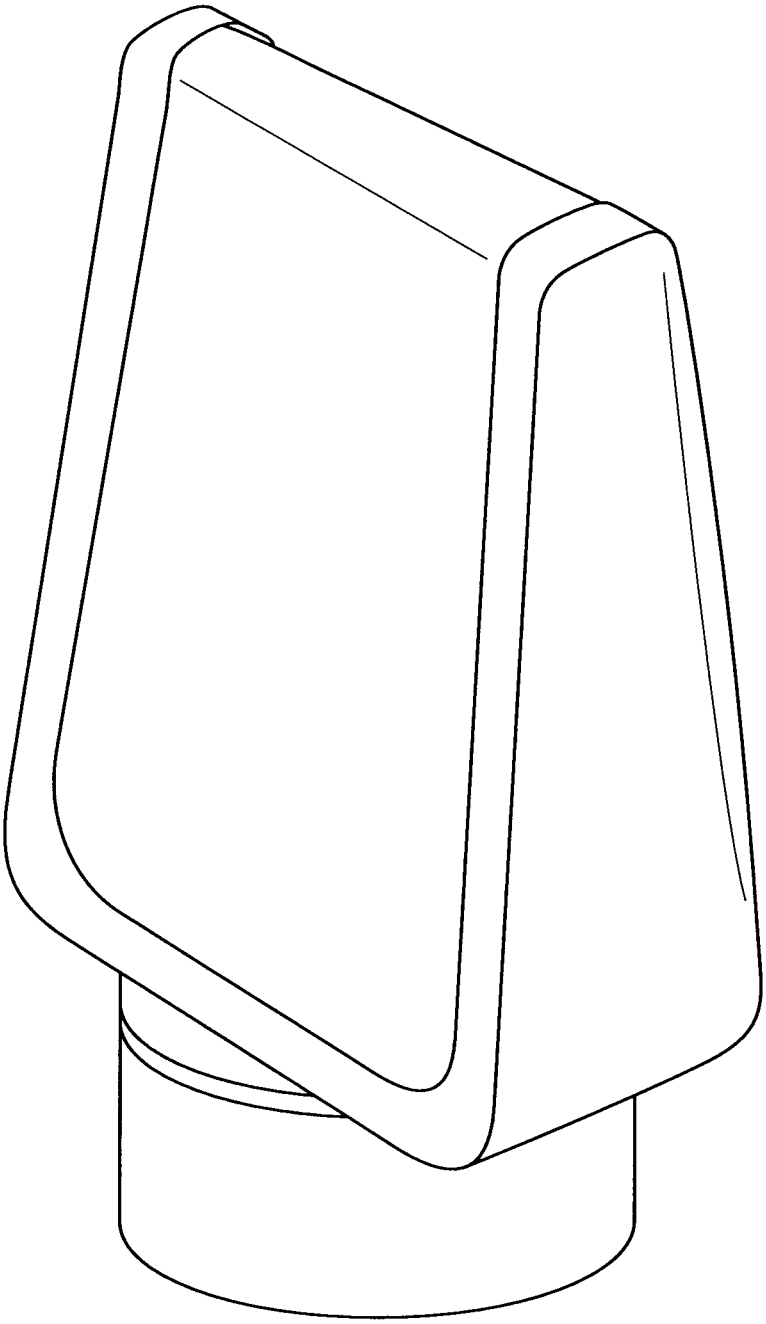
FIG. 8 is a perspective view of a locking cap apparatus according to one or more embodiments.
Figure 9:
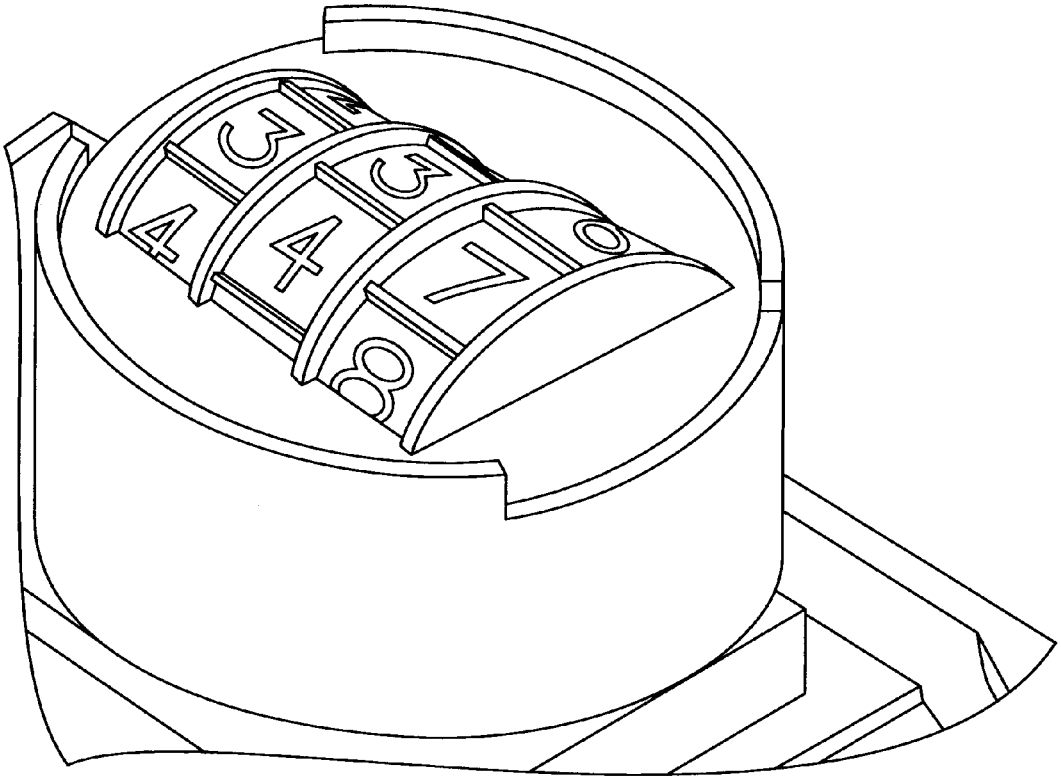
FIG. 9 is a perspective view of a portion of a locking cap apparatus according to one or more embodiments.

FIGS. 1 and 2 illustrate a locking cap apparatus 100 which includes a cap assembly 140, a bottle 110, and optionally an adapter 180 (FIGS. 6 and 7) coupled with the bottle 110. The locking cap apparatus 100 allows for the cap assembly 140 to be locked relative to the bottle 110 such that the cap assembly 140 cannot be removed from the bottle 110 by someone other than the intended user. This allows for prevention of unauthorized use of drugs, prescription drugs, alcohol, or abuse of or otherwise unauthorized use of substances stored in the bottle 110. FIGS. 8-9 illustrate additional variations for the bottle and cap assembly.

Figure 4:
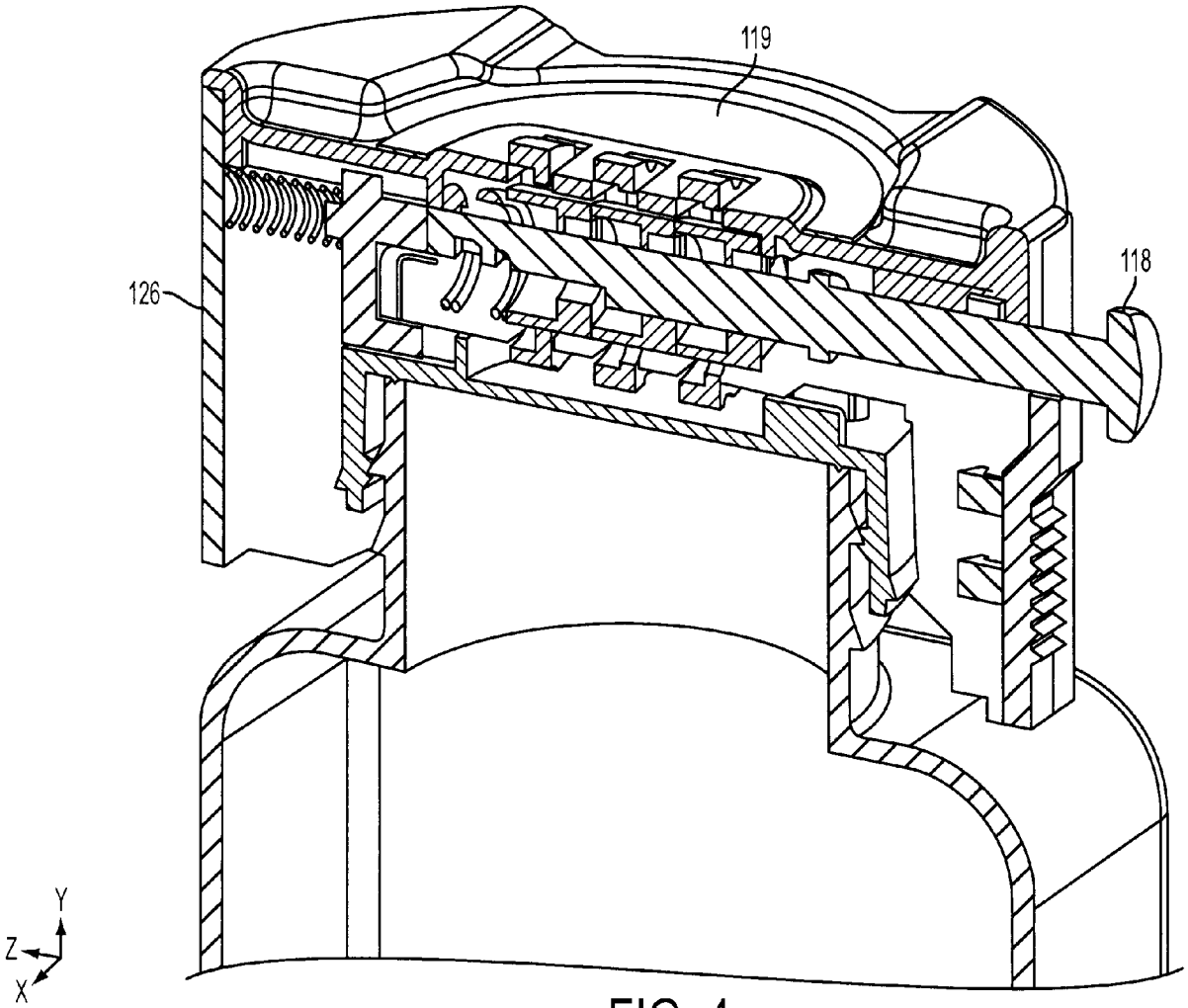
FIG. 4 is a cross-sectional view of the locking cap apparatus according to one or more embodiments.
Figure 5:
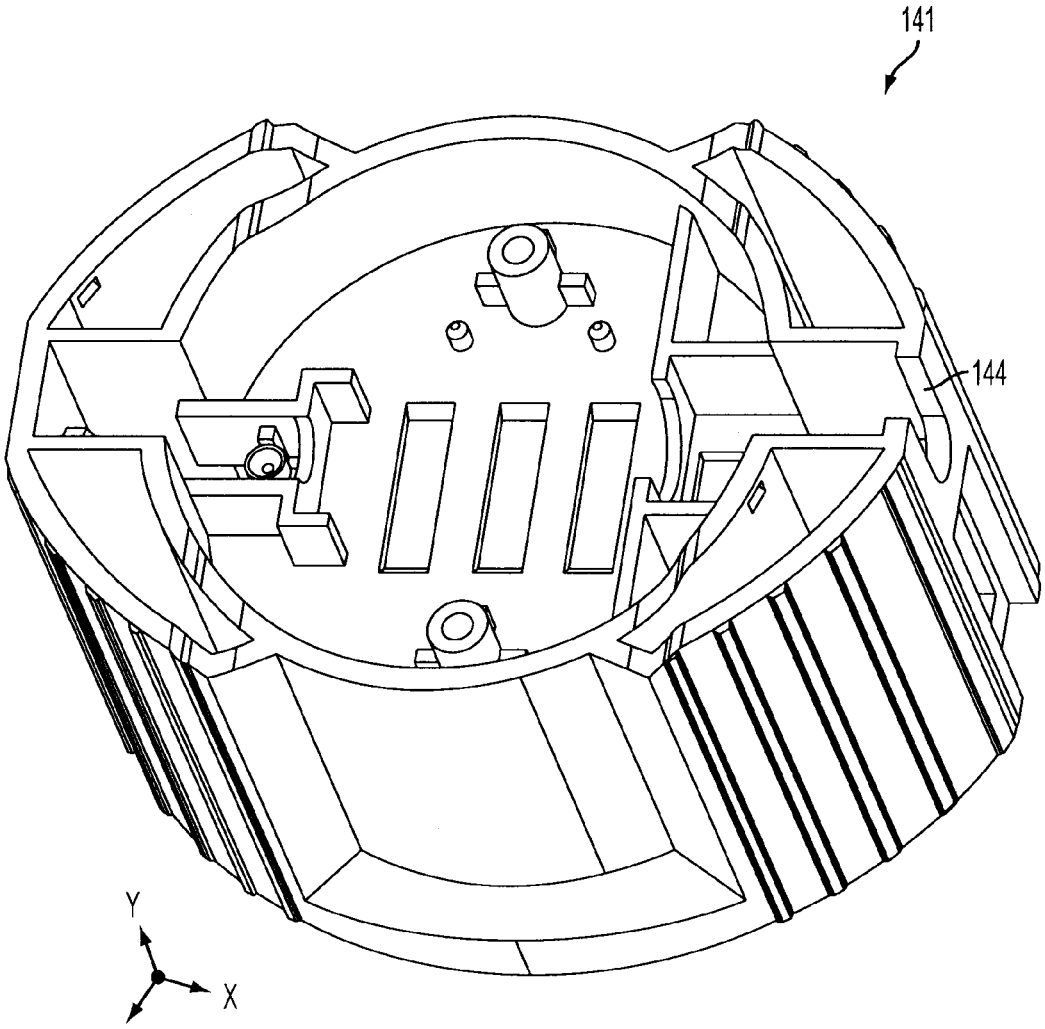
FIG. 5 is a perspective view of an outer cap of the locking cap apparatus according to one or more embodiments.

Referring to FIGS. 2-4, the cap assembly 140 includes an outer cap 141, an inner cap 142, and a locking assembly. The locking assembly includes a plunger 118 that is at least partially disposed through an opening or port 144 of the outer cap 141. The plunger 118 extends at least partially external to the outer cap 141 in the unlocked position, and optionally in the locked position. This allows the user to determine if another person has been attempting to unlock or alter the plunger 118 in an effort to remove the cap assembly from the bottle, for example by bending or breaking the plunger 118, or removing the tamper proof sticker 119.

Figure 6:
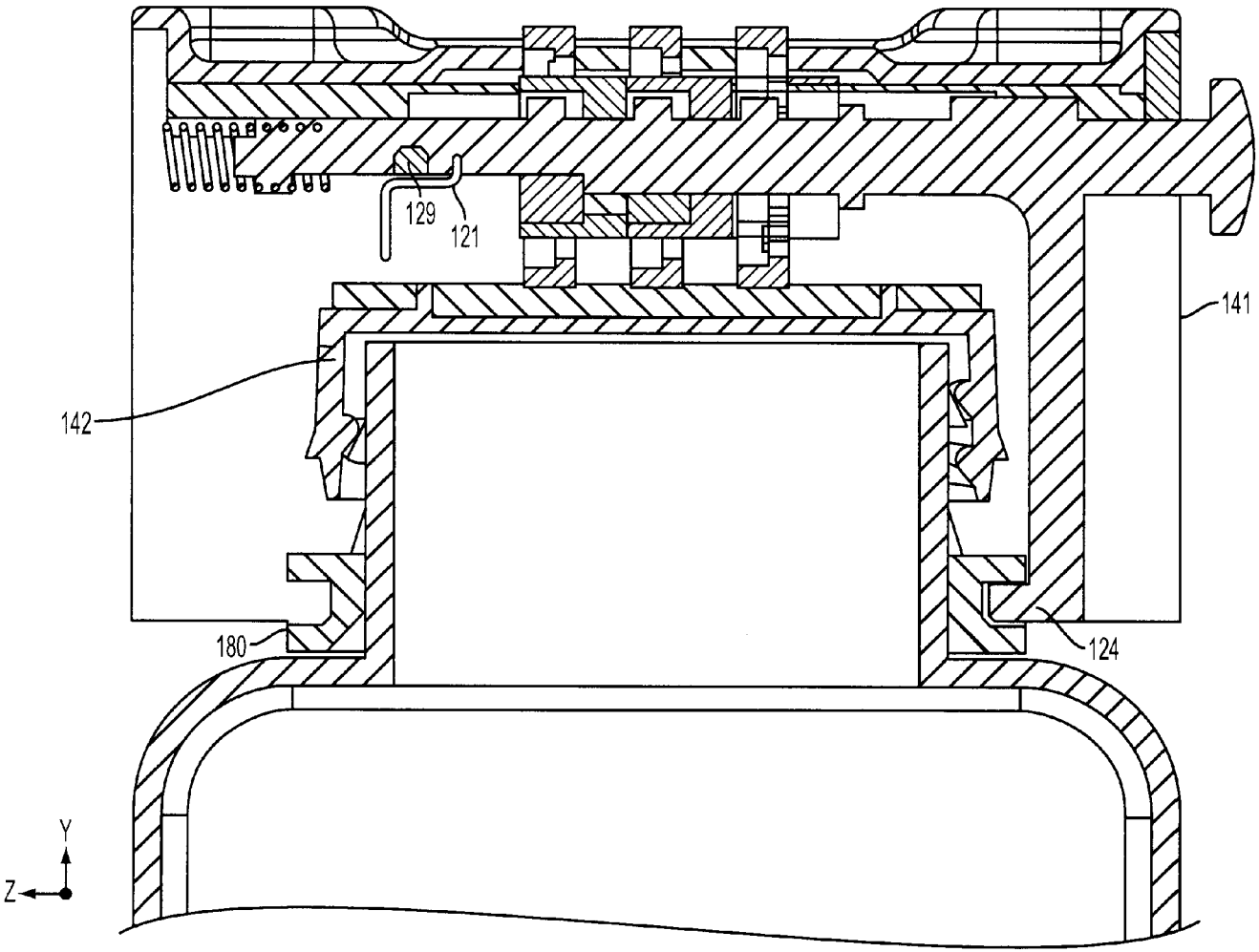
FIG. 6 is a cross-sectional view of the locking cap apparatus according to one or more embodiments, shown in the locked position.

The plunger 118 further includes a shaft that interacts with tumblers 194, the spring member 126, the inner cap 142, and the wire catch 128. The wire catch 128 has a first portion that rotatably fits within an opening of the cap 141 (FIG. 6). The wire catch 128 has a second portion that moves between a first opening 129 and a second opening 121 of the plunger shaft, depending on whether the plunger 118 is in the locked or unlocked position. In one or more embodiments, the plunger 118 further includes a locking member 124 that moves when the plunger 118 moves from the locked to unlocked position, and the unlocked to locked position (see FIGS. 6 and 7).

Referring to FIG. 2, the plunger 118 engages and disengages from the inner cap 142 via a concentric ring of teeth 147 on the top of the cap. When the plunger 118 is disengaged from the inner cap 142, the cap cannot be rotated and unscrewed from the bottle. The wire catch 128 holds the plunger at the locked and unlocked positions via a latch track in the plunger 118. The plunger action is a "latching" catch mechanism. The inner cap 142, in an option, snaps into an inner portion of the outer cap 141. A variety of sizes of the inner cap 142 can be provided to accommodate various sized bottles. In an embodiment, the inner cap 142 cannot be removed once snapped into the outer cap 141. The inner cap 142 has internal threads, which correspond to external threads on prescription bottles and/or liquor bottle threads. In an embodiment, an adapter 180 can be used to provide the external threads on a device to be locked (FIGS. 6 and 7). In another embodiment, the inner cap 142 can be sized to accommodate a variety of different sized bottles and/or threads.

When the plunger 118 is disengaged, for example, when the combination is not set, from the inner cap teeth 147, the outer cap 141 will spin freely around the inner cap 142. In an embodiment, a member such as a three-finger spring 114 maintains the number wheels in position and/or provides tactile snapping feed back to the user that the next number has been selected. The spring member 126 is used to push open the plunger 118 into the unlocked position. The tumbler spring 138 is used to keep the tumblers 194 engaged with the number wheels 192 and to return the tumblers 194 to the home position once the combination is set. An anti-tamper sticker 119 is used to cover screws 108 holding the top 139 of the outer cap 141. If the user forgets their combination but needs immediate access to their medication, the anti-tamper sticker 119 can be breached, for example, removed, and the cap assembly can be disassembled. Disruption to the sticker 119 will provide an alert that the cap assembly has been removed or attempted to be removed.

The locking mechanism, in an option, includes two or more wheels 192, such as three wheels. The wheels 131 include indicia allowing for a user to select a certain orientation of the wheels or other locking mechanism that will allow for the cap assembly 140 to be removed from the bottle 110. For example, the indicia could be the numerals 0-9, and a user could select a numerical combination such as "3-5-8" to unlock the cap 142 from the bottle 110. In an option, the wheels 131 include internal slots and/or ridges which interact with the plunger 118, such as slots or ridges external to the plunger 118.

To re-set the code of the cap assembly 140, the user will press firmly on the plunger 118, while or after the unlocking combination has been set. While holding this plunger 118 tightly, the user can then select the desired combination code. The inner tumblers 194 will remain in place while the outer members, such as number wheels 192, spin to the selected combination numbers. When selected, by letting go of the plunger 118, the catch spring retracts into the locked position and re-engages the inner tumblers 194 with the number wheels 192. If the user were to push on the outer portion of the outer cap 141 and the inner tumblers 194 when not set to the correct combination, the plunger 118 could not move. The combination would then be reset and the user could then spin the number wheels to lock the device When the user wishes to lock the cap 142 to the bottle 110, the locking mechanism is set to the previously indicated setting in order to depress the plunger 118. The plunger 118 can include an actuator integral therewith, or separate thereto. The plunger 118 is depressed toward the cap 142, depressing a resilient member such as the spring member 126 with the plunger shaft and releasing the wire catch 128. In this position, the user then scrambles or otherwise changes the indicia of the locking mechanism to thereby lock the cap assembly 140 to the bottle 110. The user releases the plunger 118, and the plunger 118 remains in the locked position held by wire catch 128, and the spring member 126 remains compressed. When in the locked position, the ridges of the shaft in combination with ridges of the locking mechanism prevent movement of the plunger 118. The wheels can be rotated or otherwise scrambled from the combination code.

When a user unlocks the cap assembly, the user first aligns the number wheels 192 to the appropriate combination code. The plunger 118 is then pressed to release the wire catch 128. This will engage plunger 118 with the teeth on the inner cap 142. When the user then rotates the outer cap 141 and the cap assembly will unscrew from the bottle.

In a further embodiment, an adapter 180 is used, for example, with liquor bottles. When the plunger 118 is in the locked position, the locking member 124 engages a second locking member of the adapter 180. The adapter 180 is coupled with the bottle 110, for example, the adapter 180 includes internal threads and is threadingly coupled with one or more external threads of a bottle 110, such as, but not limited to a prescription bottle, a liquor bottle, etc. In a further option, the adapter 180 is coupled with the bottle with an interference fit.

The adapter 180 includes the second locking member. When the first locking member is engaged with the second locking member, the cap 142 cannot be removed from the bottle 110. In an option, the cap 142 is rotatable relative to the bottle 110, even when the first locking member is engaged with the second locking member, and the plunger is in the locked position. In an option, the first locking member 124 is a projection and the second locking member 129 is a recess. It should be noted that the locking member 124 could be a recess and the second locking member 129 could be a projection, or variations or combinations of these. In a further option, the second locking member 129 can be formed on the bottle 110 or another component allowing for the cap 142 to be locked with the bottle 110.

In a further option, the cap assembly 140 includes a second locking assembly, such as a child-proof locking mechanism. The second locking assembly, in an option, includes an inner cap 142 that allows for the cap 141 to spin relative to the bottle 110 regardless if the cap assembly is locked or unlocked relative to the bottle 110. When the cap assembly is unlocked relative to the bottle, as discussed above, the inner cap 142 can still prevent the cap assembly 140 from being removed from the bottle 110, for example, using child-type lock. For example, to remove the cap assembly 140 from the bottle 110 when the plunger 118 is in the unlocked position, the user would depress the cap 142, and thus the second cap 210 would be depressed toward the bottle 110, overcoming the child-type lock, and allowing for the cap assembly 140 to be removed from the bottle 110.

In a further option, a method includes coupling a cap assembly of a locking cap apparatus to a bottle, the cap assembly including a cap assembly including a cap having a port, the cap assembly rotatably coupled with a bottle, the bottle having an opening covered by the cap assembly, a locking assembly including a plunger, the plunger having a locked and unlocked position, the plunger at least extending through the port in both the locked and the unlocked position, the plunger including a shaft and a first locking member, lock setting members interactively coupled with the shaft of the plunger, and at least one adapter 180 coupled with the bottle, the adapter 180 including a second locking member, the first and second locking members adapted to interact with one another. The method further includes setting the lock setting members to a setting, and locking the cap assembly to the bottle including depressing the plunger toward the cap assembly. In a further option, the method includes rotating the cap relative to the bottle while the cap assembly is locked to the bottle, or unlocking the cap includes rotating the cap while depressing the cap toward the bottle. In yet another option, the method includes removing the adapter 180 including rotating the adapter 180 relative to the bottle.

Figure 10A:
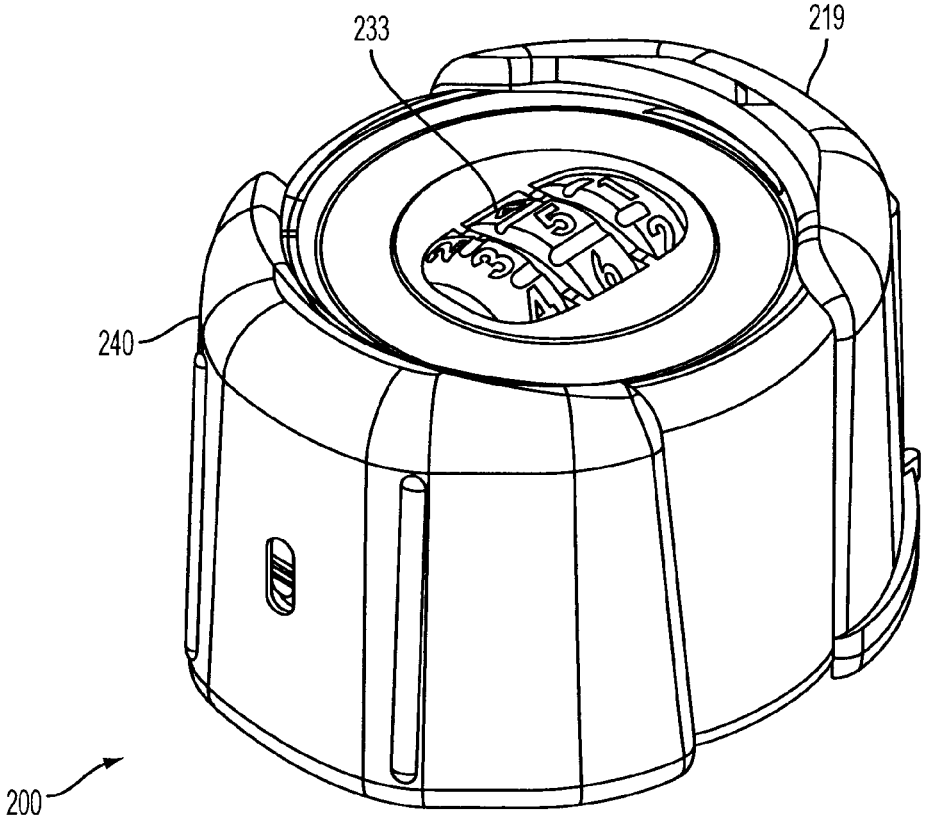
FIG. 10A illustrates an isometric view of the cap assembly in a combination change position, according to one or more embodiments.
Figure 10B:
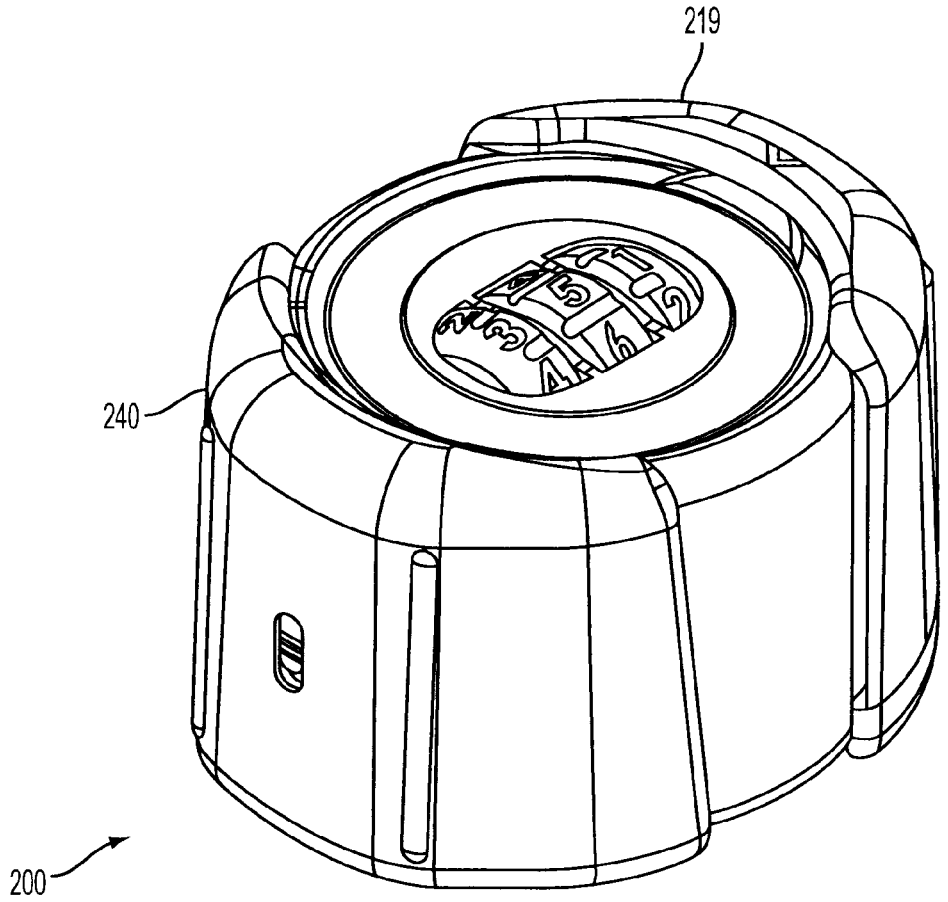
FIG. 10B illustrates an isometric view of the cap assembly in a locked position, according to one or more embodiments.
Figure 10C:
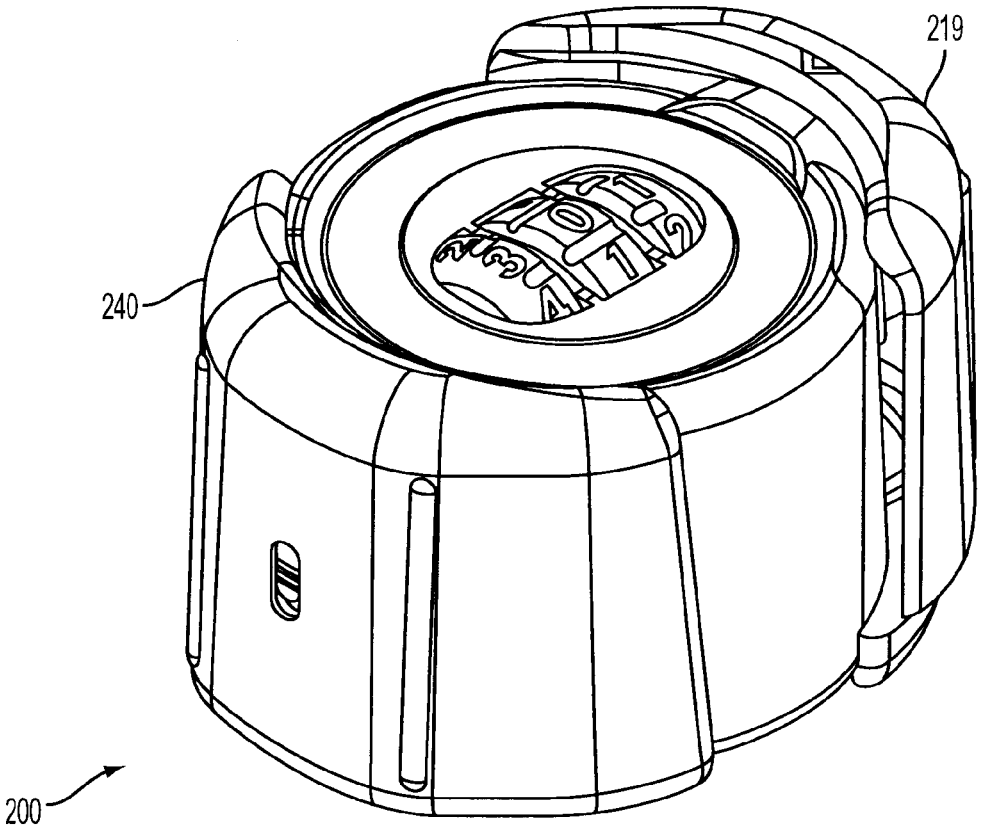
FIG. 10C illustrates an isometric view of the cap assembly in an unlocked position, according to one or more embodiments.
Figure 11A:
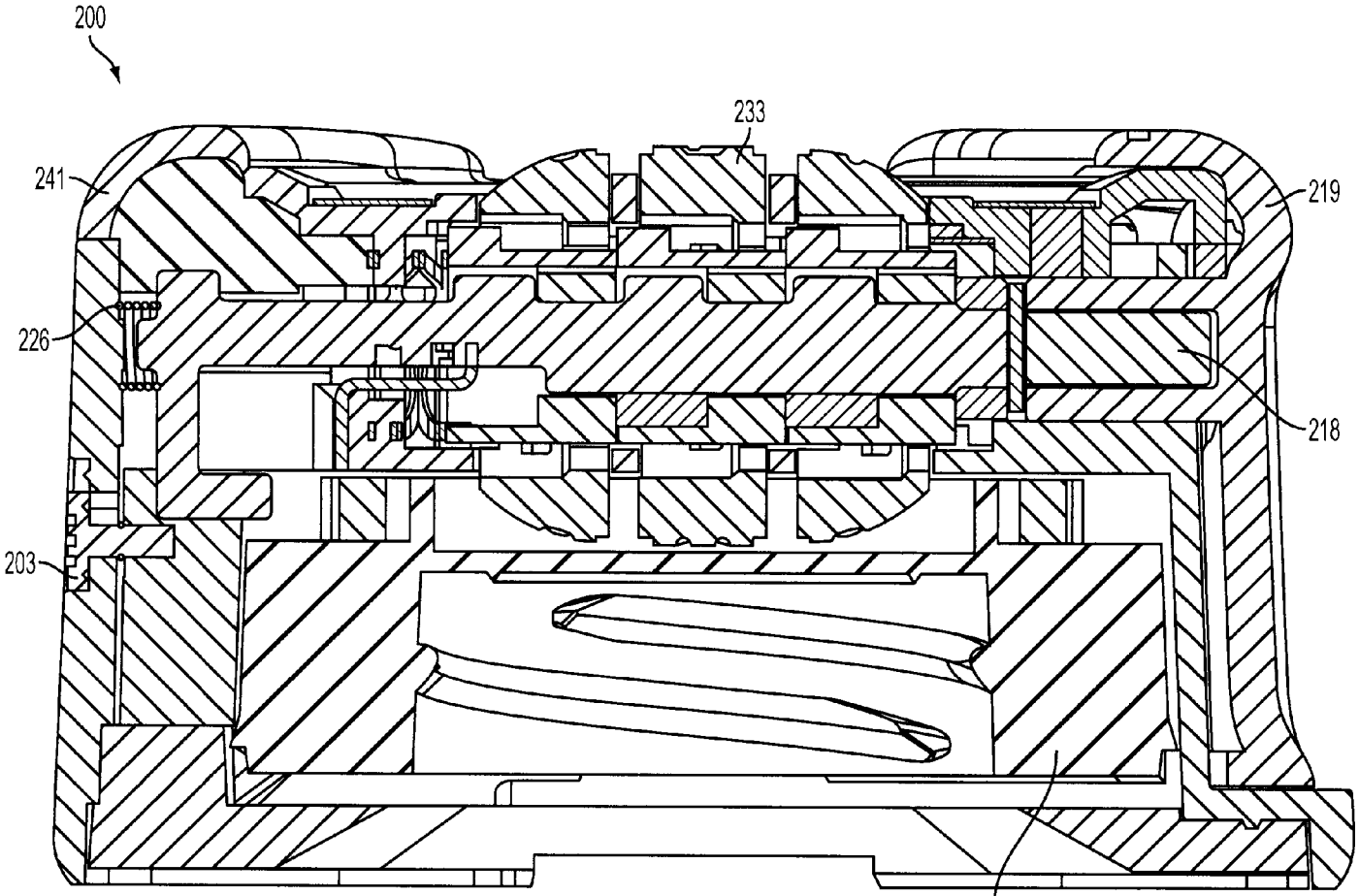
FIG. 11A illustrates a cross-sectional view of the cap assembly in a combination change position, according to one or more embodiments.
Figure 11B:
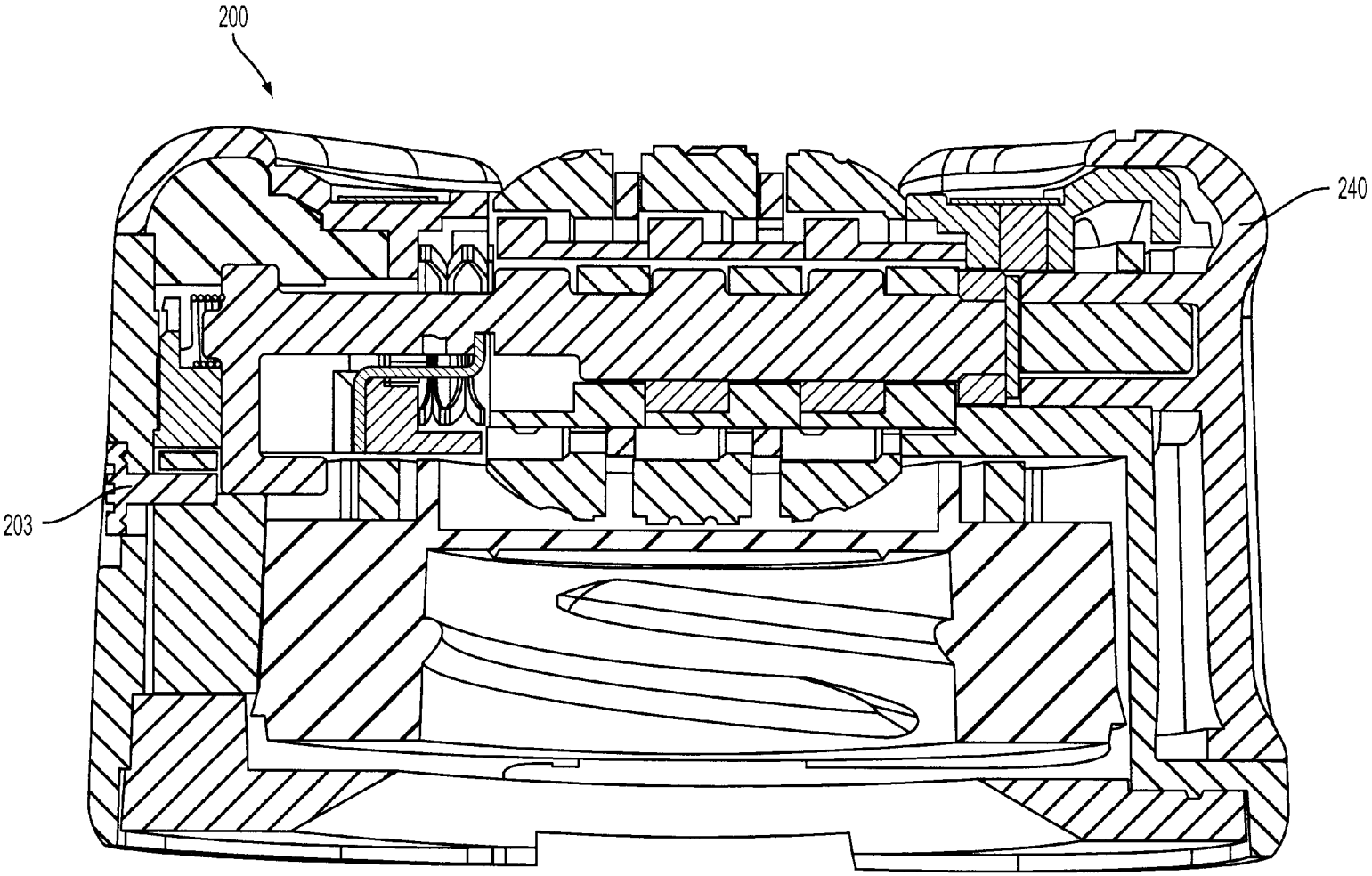
FIG. 11B illustrates a cross-sectional view of the cap assembly in a locked position, according to one or more embodiments.
Figure 11C:
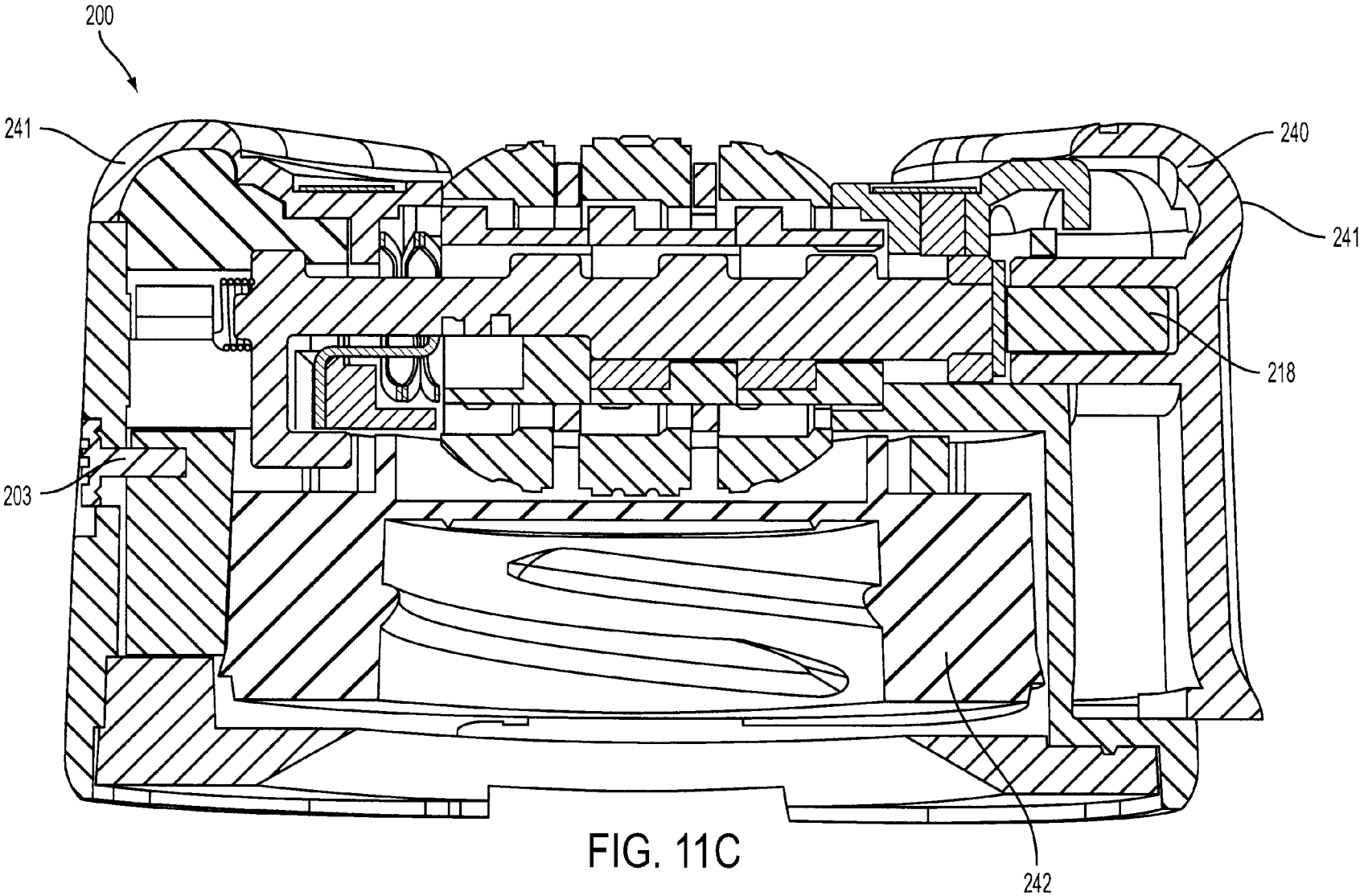
FIG. 11C illustrates a cross-sectional view of the cap assembly in an unlocked position, according to one or more embodiments.

FIGS. 10A-10C, 11A-11C, and 12 illustrate a locking cap apparatus 200 in accordance with one or more embodiments. The above discussion of FIGS. 1-9 is incorporated herein, and the embodiments and variations can be used in combination with those of FIGS. 10A-10C, 11A-11C, and 12. FIGS. 10A, 11A illustrate the locking cap apparatus 200 disposed in the lock change position, FIGS. 10B, 11B illustrate the locking cap apparatus 200 disposed in the locked position, and FIGS. 10C, 11C illustrate the locking cap apparatus 200 disposed in the open position.

Referring to FIGS. 10A, 11A, in the lock change position, the actuator 219 is depressed toward the outer cap 241, and the plunger 218 fully compresses the resilient member 226, such, as the spring, and the plunger 218 interacts with the tumblers 231 and lock setting members 233 allowing for the lock setting members 233 to be set to a particular numerical setting or combination as discussed above. In one or more embodiments, the locking cap apparatus 200 includes a lock change lock out 203, such as a slide member. The lock change lock out 203 is disposed in an access position, as shown in FIG. 11A. When in this position, the plunger is free to move into a lock change position of FIG. 11A. When disposed in a lock out position, as shown in FIG. 11B, the lock change lock out 203 prevents the plunger 218 from moving into the lock change position, and the combination will not be accidentally re-set. In one or more embodiments, the lock change lock out 203 can be slid from the access position to the lock out position, and back to the access position.

When the cap assembly 200 is in the locked position, as shown in FIGS. 10B and 11B, the outer cap 241 spins relative to the inner cap 242, and the cap assembly 240 cannot be removed from the bottle as further discussed above. For example, the plunger 218 fails to engage the inner cap 242, and does not couple the inner cap 242 with the outer cap 241.

In the open position, as shown in FIGS. 10C and 11C, the plunger 218 engages a portion of the inner cap 242, as further discussed above. For example, the plunger 218 engages a gear or a series of projections 235 on the inner cap, and effectively couples the outer cap 241 with the inner cap 242, such that the cap assembly 240 can be removed from the bottle.

Figure 12:
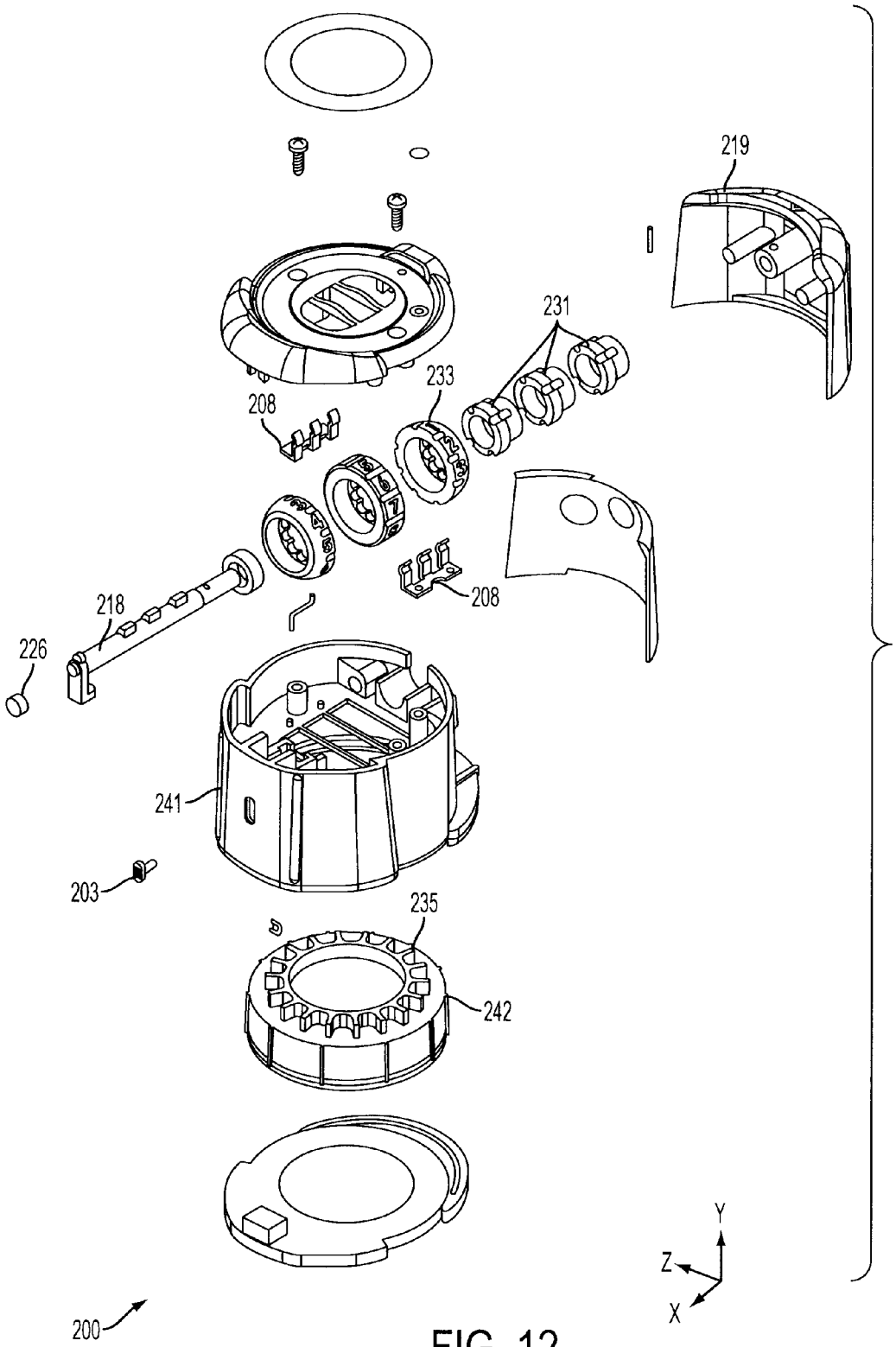
FIG. 12 illustrates an exploded view of the cap assembly in accordance with one or more embodiments.

Referring to FIG. 12, an exploded view of the locking cap apparatus 200, where the components can be seen in greater detail, and are further discussed above. Additional options include one or more wheel springs 208, allowing for a more tactile response when a user changes the number wheel to set the combination.

In one or more embodiments, a method comprises rotatably coupling a cap assembly of a locking cap apparatus to a bottle, the cap assembly including an outer cap and an inner cap received within the outer cap, the outer cap including an actuator coupled with a plunger, the plunger movable within and relative to the outer and inner cap, the cap assembly rotatably and releasably coupled with external threads of a bottle, the plunger having a locked position, an unlocked position, and a lock change position, the outer cap is rotatable relative to the bottle when the plunger is in the locked position, unlocked position, and combination change position, the inner cap is rotatable relative to the outer cap when the plunger is in the locked position, the inner cap is not rotatable relative to the outer cap and rotates with the outer cap when the plunger is in the unlocked position, the cap assembly further including lock setting members. The method further includes placing the plunger in a lock change position, setting the lock setting members to a setting, and placing the plunger in the locked position.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

The invention claimed is:

1. A locking cap apparatus comprising:

a cap assembly including an outer cap and an inner cap received within the outer cap, the outer cap including an actuator coupled with a plunger, the plunger movable within and relative to the outer and inner cap, the actuator movable relative to the outer and inner cap;

the cap assembly rotatably and releasably coupled with external threads of a bottle;

the plunger having a locked position, an unlocked position, and a lock change position;

the outer cap is rotatable relative to the bottle when the plunger is in the locked position, and unlocked position;

the inner cap is rotatable relative to the outer cap when the plunger is in the locked position;

the inner cap is not rotatable relative to the outer cap and rotates with the outer cap when the plunger is in the unlocked position, the plunger engaged with the inner cap and couples the inner cap with the outer cap in the unlocked position; and the cap assembly further including lock setting members.

2. The locking cap apparatus as recited in claim 1, further comprising an anti-tamper device coupled with the cap assembly.

3. The locking cap apparatus as recited in claim 2, wherein the anti-tamper device is a sticker disposed over fasteners, where removal of the fasteners allow disassembly of the cap assembly from the bottle.

4. The locking cap apparatus as recited in claim 1, further comprising at least one resilient member disposed between the plunger and the cap assembly.

5. The locking cap apparatus as recited in claim 1, further comprising at least one adapter coupled with the bottle, the adapter including a second locking member, the first and second locking members adapted to interact with one another, wherein the adapter includes internal threads and the internal threads are threadingly coupled with external threads of the bottle.

6. The locking cap apparatus as recited in claim 1, wherein the lock setting members further include tumblers interactively coupled with a shaft of the plunger.

7. The locking cap apparatus as recited in claim 6, wherein the plunger includes projections received by the tumblers.

8. The locking cap apparatus as recited in claim 1, wherein the inner cap includes one or more projections adapted to engage with a coupling member.

9. The locking cap apparatus as recited in claim 1, the cap assembly further includes a lock change lock out having an access position and a lock out position, where the in the lock position, the plunger cannot be disposed in the lock change position.

10. The locking cap apparatus as recited in claim 1, wherein the outer cap spins freely relative to the bottle when the plunger is in the combination change position.

11. A method comprising:

rotatably coupling a cap assembly of a locking cap apparatus to a bottle, the cap assembly including an outer cap and an inner cap received within the outer cap, the outer cap including an actuator coupled with a plunger, the plunger movable within and relative to the outer and inner cap, the cap assembly rotatably and releasably coupled with external threads of a bottle, the plunger having a locked position, an unlocked position, and a lock change position, the outer cap is rotatable relative to the bottle when the plunger is in the locked position, unlocked position, and combination change position, the inner cap is rotatable relative to the outer cap when the plunger is in the locked position, the plunger engaged with the inner cap and couples the inner cap with the outer cap in the unlocked position, the inner cap is not rotatable relative to the outer cap and rotates with the outer cap when the plunger is in the unlocked position, the cap assembly further including lock setting members;

placing the plunger in a lock change position;

setting the lock setting members to a setting; and placing the plunger in the locked position.

12. The method as recited in claim 11, wherein placing the plunger in the unlocked position includes coupling the inner cap with the outer cap, and rotating the outer cap rotates the inner relative to the bottle.

13. The method as recited in claim 11, wherein placing the plunger in the locked position includes depressing the actuator.

14. The method as recited in claim 11, wherein placing the plunger in the locked position includes releasing the actuator.

15. The method as recited in claim 11, further comprising actuating a combination lock member and preventing the lock setting member from being re-set while the combination lock member is actuated.

16. The method as recited in claim 11, further comprising disposing an adapter on the bottle and coupling the cap assembly with the adapter.

17. The method as recited in claim 11, further comprising depressing the actuator and placing the plunger in the combination change position, including disengaging the plunger from one or more tumblers.

18. The method as recited in claim 11, further comprising securing the inner cap with the outer cap when the plunger is in an unlocked position, including disposing a coupling within spokes on an upper portion of the inner cap.

19. The method as recited in claim 11, further comprising unlocking the cap includes rotating the cap while depressing the cap toward the bottle.

* * * * *